US005309840A

United States Patent [19]

Takamura et al.

[11] Patent Number: 5,309,840

[45] Date of Patent: May 10, 1994

[54] IMPASTO PATTERN FORMING METHOD

[75] Inventors: Toru Takamura; Tsutomu Yoneyama; Kazuhiko Tomaru, all of Annaka, Japan

[73] Assignee: Shin-Etsu Chemical Co., Ltd., Tokyo, Japan

[21] Appl. No.: 70,184

[22] Filed: Jun. 2, 1993

[30] Foreign Application Priority Data

Jun. 30, 1992 [JP] Japan ..... 4-168482

[51] Int. Cl.[5] ..... B41L 35/14

[52] U.S. Cl. ..... 101/488; 2/69; 2/2.15; 2/68; 156/244.16; 156/229; 430/18; 430/270; 430/320; 430/330

[58] Field of Search ..... 101/126, 129, 163, 488, 101/170, 465; 430/124, 18, 270, 320, 330; 2/69, 2.1 R; 156/234, 145, 244.16, 229, 230

[56] References Cited

U.S. PATENT DOCUMENTS

| | | | |
|---|---|---|---|
| 3,548,748 | 12/1970 | Van Dorn | 101/489 |
| 3,760,724 | 9/1973 | Budzinski et al. | 101/488 |
| 3,885,522 | 5/1975 | MacDonald et al. | 101/163 |
| 4,033,263 | 7/1977 | Richmond | 101/488 |
| 4,294,641 | 10/1981 | Reed et al. | 156/234 |
| 4,479,432 | 10/1984 | Masaki et al. | 101/170 |
| 4,627,110 | 12/1986 | Tengs | 2/69 |
| 4,760,790 | 8/1988 | Birkett | 101/488 |
| 4,963,208 | 9/1990 | Muncy et al. | 156/145 |
| 5,049,368 | 9/1991 | Turner, Jr. | 427/424 |
| 5,138,345 | 8/1992 | Tohyama et al. | 101/465 |
| 5,232,812 | 8/1993 | Morrison et al. | 430/124 |

FOREIGN PATENT DOCUMENTS

| | | |
|---|---|---|
| 0142257 | 5/1985 | European Pat. Off. . |
| 0470705 | 2/1992 | European Pat. Off. . |
| 2054197 | 2/1981 | United Kingdom . |

*Primary Examiner*—Eugene H. Eickholt
*Attorney, Agent, or Firm*—Millen, White, Zelano & Branigan

[57] ABSTRACT

An impasto pattern representing a desired character or mark is formed on a stretchable support, typically sportswear fabric by extruding a high viscosity liquid silicone rubber composition to the support through a nozzle of a robotic applicator having a picture drawing function to form a predetermined pattern of impasto extrudate on the support, and curing the extrudate.

4 Claims, 2 Drawing Sheets

IMPASTO PATTERN FORMING METHOD

This invention relates to a method for forming a impasto pattern of silicone rubber on a substrate, especially a stretchable substrate such as fabric, and more particularly, to a method for forming an impasto mark or character pattern of silicone rubber on the substrate including sportswear such as baseball uniforms, T-shirts, tennis wear, swimming suits and swimming caps.

BACKGROUND OF THE INVENTION

Casual wear becomes more fashionable. For example, T-shirts having colorful well-designed characters and marks printed thereon are popular. Sportswear also becomes colorful. For example, baseball uniforms bear numbers on the back. Clothing items for tennis, golf, swimming, aerobics and wind surfing bear attractive characters and marks thereon.

These characters and marks printed on such clothing items are generally planar. In order that such patterns be more fashionable or attractive, it is recently desired for marks and designs to have a thickness, that is, to provide an impasto or raised or three-dimensional pattern. A common practice is to attach a shaped piece of thick fabric to clothing fabric. Since most sportswear uses stretchable fabric, pieces to be attached thereto are also required to be stretchable. At present, pieces of rubber each cut to a shape are bonded to the fabric base with a hot-melt adhesive. This method, however, requires a step of cutting rubber to one or more pieces having a desired shape of character or symbol to collectively form a certain mark. The cutting step yields a quantity of waste rubber. This results in an increased cost.

It was proposed to print a room temperature vulcanizable silicone rubber to fabric as disclosed in Japanese Patent Publication (JP-B) No. 17715/1978. This method, however, requires a long time to cure and is thus unsuitable for commercial use.

Swimming caps of silicone rubber are made fashionable by printing marking ink to the cap surface by a screen printing technique. Few ink prints can be thick or impasto. One proposal for producing a sterographic feel is by engraving a mold to define a three-dimensional pattern of character or mark, pouring marking ink into the engraved mold, and transferring the ink molding to a swimming cap under pressure as disclosed in Japanese Patent Application Kokai (JP-A) No. 312110/1988. This method requires engraving of a mold for every pattern, resulting in an increased cost.

SUMMARY OF THE INVENTION

An object of the present invention is to provide a method for forming an impasto pattern on a support, especially a stretchable support such as sportswear fabric.

We have found that this and other objects can be attained by applying a technique generally known as a formed-in-place-gasket (FIPG) technique. An impasto pattern can be formed on a stretchable support, typically sportswear fabric by extruding a high viscosity liquid silicone rubber composition to the support to form a predetermined pattern of impasto extrudate on the support, and curing the extrudate to form an impasto pattern of silicone rubber representing a desired character or mark. For extrusion, a robotic applicator having a picture drawing function is used. The pattern may be either monochromatic or multi-colored and cover from a simple pattern to a combination of complex characters or a complex design. Any desired pattern can be formed without trouble and without a change except for the picture drawing function of the robotic applicator. There is obtained a compliant impasto mark of any desired design on a stretchable support. The inventive method can form an impasto pattern at low cost while eliminating rubber waste and a need for a special mold.

More particularly, the FIPG technique is known in the automotive field as a technique of applying or extruding a liquid silicone rubber composition to a flange surface by means of a robotic applicator, and pressing a member against the flange via the silicone rubber which has or has not been cured, thereby establishing a silicone rubber seal. By employing the FIPG technique to the field of forming a pattern on T-shirts and sportswear, a silicone rubber characterized by freedom of coloring, weatherability and flexibility can be applied to a support as a raised pattern or relief which has a thickness over the support surface. Preferably the silicone rubber composition used is a thermosetting or ultraviolet-curable, one-part, self-adhesive silicone rubber composition because it can be quickly cured by heating or UV exposure, ensuring working advantages.

Therefore, the present invention provides a method for forming an impasto or raised pattern, comprising the steps of: extruding a high viscosity liquid silicone rubber composition to a stretchable support through a nozzle of a robotic applicator having a picture drawing function to form a predetermined pattern of impasto extrudate on the support, the pattern representing a desired character or mark, and curing the extrudate to form an impasto pattern of silicone rubber.

DETAILED DESCRIPTION OF THE INVENTION

Figure 1:
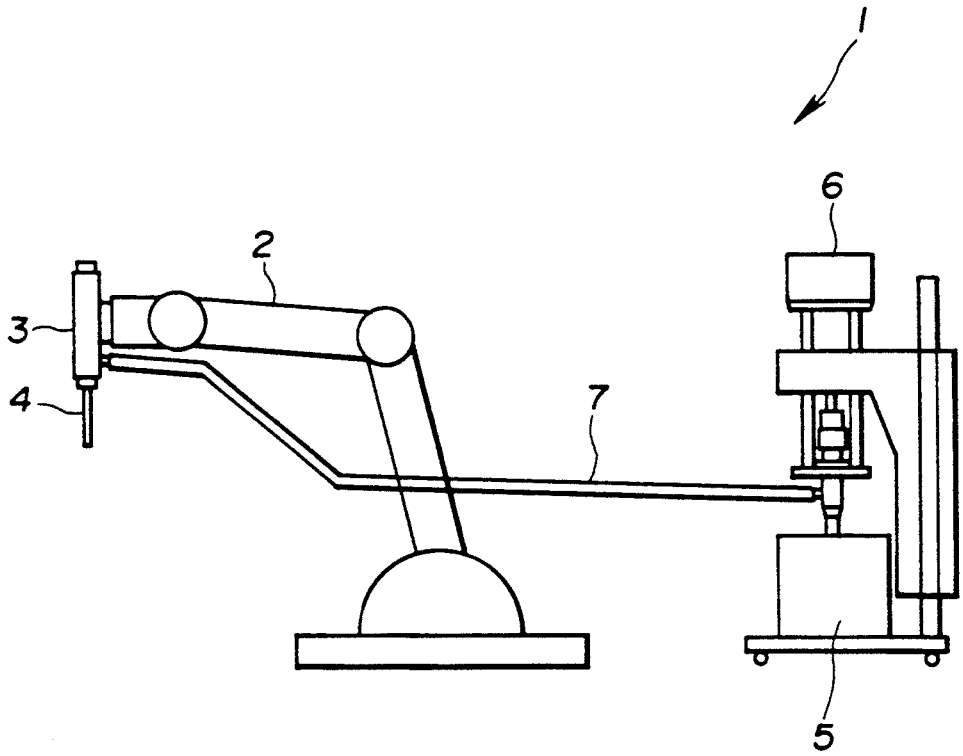
FIG. 1 is a schematic illustration of a robotic applicator used in Examples.

The method of the invention uses a high viscosity liquid silicone rubber composition to form a three-dimensional or impasto pattern.

The liquid silicone rubber composition is preferably a thermosetting or ultraviolet-curable, one-part, self-adhesive silicone rubber composition although condensation-curable silicone rubber compositions are acceptable. Broadly speaking, there may be used any of liquid silicone rubber compositions which are conventionally used in FIPG. The liquid silicone rubber composition should have a high viscosity enough for the composition to sustain a certain height from the support surface for forming a raised indication. Then the fluidity and viscosity of the composition is selected in accordance with the required height of the raised indication. Preferably, the viscosity of the composition is in the range of 10 to 500,000 poises, more preferably 1,000 to 50,000 poises.

More particularly, the liquid silicone rubber compositions contain a linear siloxane polymer having a degree of polymerization of 100 to 2,000 as a major component, with fillers and additives blended. The compositions are generally classified into one-and two-part systems and into condensation curing, addition curing and UV curing types in terms of curing mechanism.

Exemplary compositions of the condensation curing type contain 100 parts by weight of a linear siloxane polymer having at least two hydroxyl groups in a molecule, 0.5 to 25 parts by weight of a crosslinking agent in the form of a low molecular weight polyfunctional siloxane having an alkoxy, amino, oxime, acetone or amide group in a molecule. They are loaded with fillers such as fumed silica, ground quarts, calcium carbonate, Celite®, and radiolarite in an amount of 0.5 to 100 parts by weight per 100 parts by weight of the linear siloxane polymer, and blended with curing promoters such as organic tin compounds and organic titanium compounds in an amount of 0.1 to 5 parts by weight per 100 parts by weight of the linear siloxane polymer.

Exemplary compositions of the addition curing type contain a linear siloxane polymer having at least two alkenyl groups in a molecule and a siloxane polymer having at least two hydrogen atoms directly bonded to silicon atoms or at least two SiH groups in a molecule as major components, fillers such as fumed silica and ground quartz, and catalytic amounts of platinum or platinum compounds.

Exemplary compositions of the UV curing type contain a linear siloxane polymer having an alkenyl group in a molecule and a siloxane polymer having at least two SiH or mercapto groups in a molecule as major components, fillers such as fumed silica and ground quartz, and initiators such as benzophenones. 0.5 to 100 parts by weight of adhesive aids per 100 parts by weight of the linear siloxane polymer may be blended to these compositions for providing self adhesion.

According to the present invention, such a liquid silicone rubber composition is extruded to the support surface through a nozzle of a robotic applicator having a picture drawing function to form a predetermined pattern of impasto extrudate on the support, which is then cured. In this case, the pattern should preferably have a thickness of 0.25 to 9 mm, particularly 0.5 to 3 mm.

The robot used herein is a robotic applicator conventionally used in the prior are FIPG. Such a robotic applicator has a picture drawing function and generally includes a metering pump in the form of a pail pump, and a dispenser connected to the pump. If the pump has not a metering function, a metering discharge mechanism such as a gear pump or plunger pump may be interposed between the pump and the dispenser. An exemplary robotic applicator is illustrated in FIG. 1. The robotic applicator generally designated at 1 includes a robot body having a picture drawing mechanism built therein, a movable arm 2 extending therefrom, a plunger 3 at the distal end of the arm 2, and a nozzle 4 at the lower end of the plunger 3. A storage tank 5 containing a liquid silicone rubber composition is connected to the plunger 3 through a metering pump 6 and a feed conduit 7. Then the silicone rubber composition is pumped from the tank 5 to the plunger 3 and extruded through the nozzle 4 under the control of the picture drawing mechanism in the robot body so that the extrudate may form a predetermined pattern corresponding to a desired character or mark. Either a XY robot or a multi-axis robot may be used although a multi-axis robot is desired for application to a curved surface. In order to form a multi-color pattern, a plurality of robotic applicators or a robotic applicator having a plurality of nozzles may be used.

The support on which an impasto pattern is formed according to the present invention is not limited in material and shape. Included are fabric, plastics, rubber, metals, paper, ceramics, and wood. The invention is applicable to, for example, clothes such as baseball uniforms, T-shirts, tennis wear, golf wear, swimming suits, wet suits, and racing suits; name plates and other pieces of wood, metal and stone; helmets and other articles of metals and plastics; and rubbery items such as swimming caps and diving masks.

The finally formed impasto indication may be a collection of characters or a mark, for example, signs, logo marks, and letters.

After a raised or impasto extrudate of liquid silicone rubber composition is applied to the support surface, it may be cured by heating, for example, oven heating or infrared heating preferably at 60° to 200° C. if the composition is thermosetting, or by exposing to ultraviolet radiation preferably at 100 to 10,000 mJ/cm$^2$ if the composition is UV curable. An impasto pattern of silicone rubber is completed in this way.

EXAMPLE

Examples of the present invention are given below by way of illustration and not by way of limitation.

EXAMPLE 1

Figure 2A:
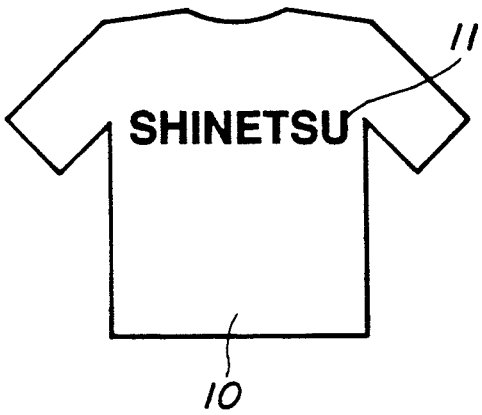
FIGS. 2(*a*) and 2(*b*) are plan and side views of a T-shirt having an impasto mark formed thereon in Example 1.
Figure 2B:
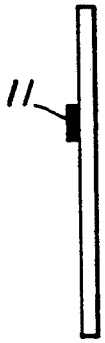

Using a robotic applicator as shown in FIG. 1, a one-part, self-adhesive silicone rubber composition of addition curing type which is composed of 100 parts by weight of vinyl group-containing linear siloxane polymer, 2 parts by weight of SiH group-containing siloxane polymer, 15 parts by weight of fumed silica, 1 part by weight of adhesive aid, 0.2 parts by weight of platinum catalyst and 0.1 parts by weight of controlling agent for addition reaction (KE-1825 available from Shin-Etsu Chemical Co., Ltd.) was extruded through the nozzle onto a T-shirt set on a platform. A protuberant extrudate of the silicone rubber composition was applied to the T-shirt 10 in a pattern 11 of "SHINETSU" as shown in FIG. 2. The extrudate was then cured by heating the shirt in an oven at 120° C. for one hour. Each of the characters had a line width of about 3.5 mm and a thickness of about 1.0 mm.

The T-shirt was repeatedly washed in a washing machine to find that the pattern or indication 11 on the T-shirt was fully fast to 20 times of washing.

EXAMPLE 2

Figure 3A:
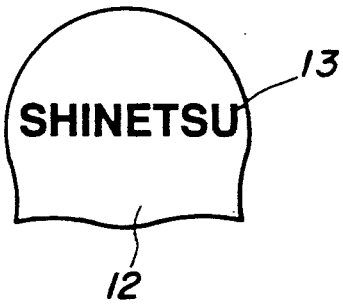
FIGS. 3(*a*) and 3(*b*) are plan and side views of a swimming cap having an impasto mark formed thereon in Example 2.
Figure 3B:
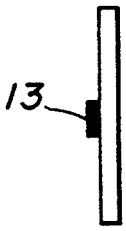

Using the same robotic applicator and one-part, self-adhesive silicone rubber composition as in Example 1, an impasto indication 13 of "SHINETSU" was formed on a swimming cap 12 of silicone rubber as shown in FIG. 3.

EXAMPLE 3

Using the same robotic applicator as in Example 1, an UV curing type silicone rubber composition (X-31-737) available from Shin-Etsu Chemical Co., Ltd.) was extruded through the nozzle onto a T-shirt set on a platform. A protuberant extrudate of the silicone rubber composition was applied to the T-shirt in a pattern of "SHINETSU". The extrudate was then cured by irradiating an ultraviolet ray at 4.5 J/cm$^2$ (4500 mJ/cm$^2$) with a high-pressure mercury lamp.

The T-shirt was repeatedly washed in a washing machine to find that the pattern on the T-shirt was fully fast to 20 times of washing. Each of the characters had a line width of about 1.5 mm and a thickness of about 0.8 mm.

There has been described a raised or impasto pattern forming method which can readily form fashionable impasto patterns on any desired support, typically T-shirts and sportswear.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for forming an impasto pattern, comprising the steps of:

extruding a high viscosity liquid silicone rubber composition which is a thermosetting or ultraviolet-curable, one part, self-adhesive silicone rubber composition to a support through a nozzle of a robotic applicator having a picture drawing function to form a predetermined pattern of impasto extrudate on the support, and curing the extrudate to form an impasto pattern of silicone rubber representing a desired character or mark wherein said support is stretchable.

2. A method as in claim 1, wherein the stretchable support is comprised of fabric.

3. A method for forming an impasto pattern, comprising the steps of:

extruding a high viscosity liquid silicone rubber composition which is a thermosetting or ultraviolet-curable, one part, self-adhesive silicone rubber composition to a support through a nozzle of a robotic applicator having a picture drawing function to form a predetermined pattern of impasto extrudate on the support, and curing the extrudate to form an impasto pattern of silicone rubber representing a desired character or mark wherein the stretchable support is selected from the group consisting of baseball uniforms, sports uniforms, T-shirts, golf wear, swimming suits, wet suits, racing suits, swimming caps and diving masks.

4. A method for forming an impasto pattern, comprising the steps of:

extruding a high viscosity liquid silicone rubber composition which is a thermosetting or ultraviolet-curable, one part, self-adhesive silicone rubber composition to a support through a nozzle of a robotic applicator having a picture drawing function to form a predetermined pattern of impasto extrudate on the support, and curing the extrudate to form an impasto pattern of silicone rubber representing a desired character or mark, wherein the stretchable support is selected from the group consisting of baseball uniforms, sports uniforms, T-shirts, golf wear, swimming suits, wet suits, racing suits, swimming caps and diving masks, whereby the impasto pattern is firmly adhered to the stretchable support so as not to be removed from the stretchable support by washing.

* * * * *

UNITED STATES PATENT AND TRADEMARK OFFICE

CERTIFICATE OF CORRECTION

PATENT NO. : 5,309,840

DATED : May 10, 1994

INVENTOR(S) : Toru TAKAMURA et al.

It is certified that error appears in the above-indentified patent and that said Letters Patent is hereby corrected as shown below:

Title Page: Item (30) Foreign Application Priority Data

Change " June 30, 1992 " to read . .

- - June 03, 1992 - -

Signed and Sealed this

Thirtieth Day of August, 1994

*Attest:*

*Attesting Officer*

BRUCE LEHMAN

*Commissioner of Patents and Trademarks*